US006042944A

United States Patent [19]

Pitowski

[11] Patent Number: 6,042,944

[45] Date of Patent: Mar. 28, 2000

[54] PROCESS FOR MANUFACTURING CELLULOSE FORMED OBJECTS AND A YARN OF CELLULOSE FILAMENTS

[75] Inventor: Jurgen Pitowski, Miltenberg, Germany

[73] Assignee: Akzo Nobel NV, Arnhem, Netherlands

[21] Appl. No.: 09/215,216

[22] Filed: Dec. 18, 1998

Related U.S. Application Data

[62] Division of application No. 08/849,553, filed as application No. PCT/EP95/04634, Nov. 24, 1995, Pat. No. 5,902,532.

[30] Foreign Application Priority Data

Dec. 2, 1994 [DE] Germany ..... 44 42 890

[51] Int. Cl.[7] ..... D02G 3/00

[52] U.S. Cl. ..... 428/393; 428/364

[58] Field of Search ..... 424/364, 393

[56] References Cited

U.S. PATENT DOCUMENTS

| | | | |
|---|---|---|---|
| 4,144,080 | 3/1979 | McCorsely, III . | |
| 4,246,221 | 1/1981 | McCorsely | 536/56 |
| 4,324,593 | 4/1982 | Varga | 106/203 |
| 4,416,698 | 11/1983 | McCorsely, III . | |
| 5,252,284 | 10/1993 | Jurkovic et al. . | |
| 5,543,101 | 8/1996 | Ruf et al. . | |
| 5,589,125 | 12/1996 | Zikelli et al. . | |
| 5,824,115 | 10/1998 | Kubuta et al. | 106/163.01 |

FOREIGN PATENT DOCUMENTS

| | | |
|---|---|---|
| 494 851 A2 | 1/1992 | European Pat. Off. . |
| 494 852 A2 | 1/1992 | European Pat. Off. . |
| 277 289 | 3/1990 | Germany . |
| 2 307 203 | 5/1997 | United Kingdom . |
| WO 93/19230 | 9/1993 | WIPO . |
| WO 94/24343 | 10/1994 | WIPO . |
| WO 94/28218 | 12/1994 | WIPO . |

OTHER PUBLICATIONS

R. Jahrling, "Die Herstellung Der Zellwolle Und Kunstseide" (1957), p. 323.

DDR–Fachbereichsstandard Viskoseseide (1983).

DDR–Standard Polyamidseide (1973).

German Search Report, P 44 42 890.1–44, Jan. 9, 1995.

Derwent—Abstract 94–290987/36 of Japanese Patent Application 06220213 (Published Aug. 9, 1994).

Derwent—Abstract 89–266892/37 of Japanese Patent Application 01193338 (Published Aug. 3, 1989).

*Primary Examiner*—Newton Edwards

*Attorney, Agent, or Firm*—Oliff & Berridge, PLC

[57] ABSTRACT

Process for manufacturing cellulose formed objects, whereby a solution of cellulose is formed in the warm state in a tertiary amine N-oxide and, if necessary, water and the formed solution is cooled with air before introducing it into a coagulation bath. Conditioned air is employed for cooling which exhibits a water content of 0.1 to 7 g water vapor per kg dry air and whose relative humidity amounts to less than 85%.

4 Claims, No Drawings

PROCESS FOR MANUFACTURING CELLULOSE FORMED OBJECTS AND A YARN OF CELLULOSE FILAMENTS

This is a Division of application Ser. No. 08/849,553 filed Jun. 3, 1997 (U.S. National Stage of PCT/EP95/04634, filed Nov. 24, 1995), U.S. Pat. No. 5,902,532. The entire disclosure of the prior application is hereby incorporated by reference herein in its entirety.

BACKGROUND OF THE INVENTION

1. Field of the Invention

The invention relates to a process for manufacturing cellulose formed objects, whereby a solution of cellulose is formed in the warm state in a tertiary amine N-oxide and, if necessary, water and the formed solution is cooled with air before introducing it into a coagulation bath, as well as a yarn of cellulose filaments.

2. Description of the Related Art

Such a process is described in WO 93/19230, whereby the cooling is to take place immediately after the forming. The object of this process is to reduce the stickiness of the freshly extruded formed objects so that a spinneret with a high hole density can be employed for manufacturing cellulose filaments. For cooling, the formed solution is preferably exposed to a gas stream.

A cooling of the warm formed solution already takes place as the formed solution leaves the forming tool, for instance a spinneret, in which temperatures are typically above 90° C., and reaches into the so-called air gap. The area between the forming tool and the coagulation bath in which the cellulose is precipitated is referred to as the air gap. The temperature in the air gap is lower than in the spinneret, but it is significantly higher than the room temperature due to the heat radiation from the spinneret and the warm-up of the air due to the enthalpy flow of the formed objects. Due to the continuous evaporation of water which is usually used as a coagulation bath, humid warm conditions prevail in the air gap. The measure proposed in WO 93/19230, that is to cool the formed solution immediately after the forming, results in a more rapid cooling so that the stickiness of the formed solution decreases more rapidly as a result.

SUMMARY OF THE INVENTION

The present invention is based on the objective to improve such a process, and in particular to improve the properties of the formed objects produced herewith, preferably filaments or a filament yarn.

This objective is met by a process for manufacturing cellulose formed objects whereby a solution of cellulose is formed in the warm state in a tertiary amine N-oxide and, if necessary, water and the formed solution is cooled with air before introducing it into a coagulation bath, whereby conditioned air is employed for cooling which exhibits a water content of 0.1 to 7 g water vapor per kg dry air and whose relative humidity amounts to less than 85%.

The water content of the conditioned air is preferably 0.7 to 4 g water vapor per kg dry air, and more particularly 0.7 to 2 g. The cooling can be carried out by streaming air, whereby this air is blown against the formed solution or drawn away from it. The drawing away can be carried out in such way that conditioned air is provided and is drawn through e.g. a bundle of freshly spun fibers or filaments. A combination of blowing and drawing away is especially advantageous.

The formed solution can be exposed to the conditioned air throughout the entire pathway up to the point of introduction into the coagulation bath, or only over a portion of this pathway, whereby it is advantageous to carry out the application of air in the first part, i.e. in the area of the air gap which is immediately adjacent to the forming tool. The conditioned air should flow at an angle of 0 to 1200, preferably 900, in relation to the direction of movement of the formed solution, whereby the angle of 0° corresponds to a flow opposite to the running direction of the formed solution.

DETAILED DESCRIPTION OF THE PREFERRED EMBODIMENTS

With the process of the invention, fibers, in particular filaments, films, hollow filaments, membranes, e.g. for applications in dialysis, oxygenation or filtration, can be manufactured in an advantageous fashion. The forming of the solution to a desired cellulose formed object can be carried out by known spinnerets for manufacturing fibers, slit nozzles or hollow filament nozzles. Subsequent to the forming, i.e. prior to the introduction of the formed solution into the coagulation bath, the formed solution can be drawn.

A yarn of cellulose filaments, produced from a solution of cellulose in a tertiary amine N-oxide, and if necessary water, is characterized in that the cross-sectional areas of the filaments exhibit a coefficient of variation lower than 12%, preferably lower than 10%.

As already described it is advantageous to cool the freshly extruded formed objects in the air gap, in order to reduce their stickiness in less time. In order to cool at all, the gas stream must by nature exhibit a temperature which is below the temperature of the formed solution. According to WO 93/19230 a gas stream is employed which has a temperature ranging from −6 to 24° C.

It has been found, however, that not the temperature itself but rather the water content of the air and its relative humidity significantly affect the properties of the cellulose formed objects. The water content of air in g water vapor per kg dry air is often also referred to as the mixing ratio. In the following, reference to this is simplified by the unit g/kg. Especially during the manufacture of filaments it has been found to be important to create climatic conditions as constant as possible in the air gap, i.e. to eliminate the effect of normal variations in the ambient climate. Thereby it is particularly important that variations in the air humidity are avoided and that the water content of the air is low. Even with air conditioning systems seasonal variations and to some degree daily variations in rooms cannot be adequately suppressed. In addition, the conditioning should be carried out as uniformly as possible since even small instabilities concerning the strength and direction of blowing can negatively influence the strength, elongation, and the titer constancy of the filaments.

The influence of the water content or the mixing ratio is demonstrated during the filament production, in particular by irregularities in the filament cross-sections. When cooled with air conditioned to 20° C. and a water content of 14 g/kg and a relative humidity of 94%, the coefficient of variation of the filament cross-sectional areas amounts to 30% in a yarn with 50 individual filaments. When the water content is reduced to 1.2 g/kg and relative humidity is lowered to 8.5%, the coefficient of variation is reduced to 5.8% at the same temperature. Even when warmer air is employed, conditioned for instance to 40° C. but with a lower water content of 3.4 g/kg and a relative humidity of 7.4%, the resulting coefficient of variation is 11.3%, which is consequently smaller by a factor of 2.7 than when cooler air with higher humidity is used. According to the invention it is therefore important to carry out a conditioning of the air gap with dry air. The temperature of the cooling air plays a subordinate role in the process.

The invention will be explained and described in the following in further detail with reference to further examples.

EXAMPLES

The above mentioned examples and also the examples explained in the following were obtained in that a solution of 14 per cent by weight Viscokraft ELV chemical wood pulp (International Paper Company) with a degree of polymerization of 680, approx. 76 per cent by weight N-methylmorpholine-N-oxide (NMMO), a tertiary amine N-oxide, 10 per cent water by weight and 0.14 per cent gallic acid propyl ester by weight as a stabilizer were spun into a filament yarn through a spinneret plate with 50 holes, each with a 130 $\mu$m diameter. The filaments formed in the spinneret (T=110° C.) were cooled in an air gap spanning 18 cm. In the air gap air was blown with a velocity of 0.8 m/s perpendicularly to the filament bundle. The air was blown from one side toward the bundle, and the homogeneous distribution of the air was obtained via very narrow-meshed sieves of 10 cm width. The blowing was carried out for 10 cm starting at the exit from the nozzle.

The filaments were drawn in the air gap by a factor of 16 and were dried after passage through a water bath for coagulation and subsequent washing baths for removal of the NMMO. The drawing speed amounted to 420 m/min.

The respective filament bundles obtained were cut 2 times perpendicularly to the bundle axis at an interval of one meter. The cross-sectional areas of the filaments were transmitted via a light microscope (magnification 570:1) and a video camera into a computer image analysis system (Quantimet 970) and evaluated. The area of each filament was determined. From the mean of the filament cross-sectional areas of each examined bundle, whereby two section pictures per bundle were evaluated, and the standard deviation, the coefficient of variation of the filament cross-sectional area was calculated in per cent as the ratio of standard deviation to the mean.

The production of conditioned air proceeded from air at room temperature, 21° C., with a water content of 9.2 g/kg and a relative humidity of 60%, and which was first cleaned by a filter. To increase the mixture ratio, the air was mixed with air at 80° C. saturated with water vapor (relative humidity 100%). To obtain a mass flow m(x) of conditioned air with a water content x, a mass flow $m_u$ of ambient air with a water content $x_u$ was mixed with a mass flow of water-vapor-saturated air $m_h$ with a water content $x_h$ according to $m(x)=m_u+m_h$. The mixture ratio $m_U:m_h$ is calculated with the following equation:

$$\frac{m_u}{m_h} = \frac{(x_h - x)(1 + x_u)}{(x - x_u)(1 + x_h)}$$

The air stream resulting herefrom was subsequently cooled to the desired temperature with a heat exchanger. The relative humidity and the water content were determined by means of a psychrometer (ALMEMO 2290-2 with psychrometer sensor AN 846 or humidity/temperature sensor AFH 9646-2).

For reducing the water content, the ambient air was cooled until it reached a relative humidity of 100%. Subsequently a further cooling took place and the condensed water was separated. With this procedure the air could be dried to a water content of approx. 4 g/kg. Subsequently the air was reheated to the desired temperature. The relative humidity and the water content were measured by means of the psychrometer.

To obtain conditioned air with a water content below 4 g/kg, the air, which was predried beforehand through a condensation process, was further dried using an air dehumidifier (Munters model 120 KS). The reheating of the dry air was carried out as well by means of a heat exchanger. The relative humidity and the water content of the air, which was dried to a water content below 4 g/kg, was determined by means of a mirror cooled dew point measuring device (MICHELL Instruments S4000 RS).

The following tables specify the examined air conditions, characterized by the temperature (T/° C.), the water content (x/(g/kg)) and the relative humidity (rH/%), and the coefficients of variation of the filament cross-sectional areas

TABLE 1

Examples according to the invention

| Example | T/° C. | x/(g/kg) | rH/% | V/% |
|---|---|---|---|---|
| 1 | 6 | 4.7 | 80 | 8.1 |
| 2 | 6 | 1.8 | 30 | 5.0 |
| 3 | 10 | 1.7 | 22 | 5.0 |
| 4 | 10 | 2.3 | 30 | 6.1 |
| 5 | 10 | 3.0 | 39 | 6.6 |
| 6 | 10 | 3.8 | 50 | 6.5 |
| 7 | 10 | 4.8 | 62 | 7.7 |
| 8 | 10 | 5.4 | 68 | 8.5 |
| 9 | 10 | 0.9 | 11 | 5.0 |
| 10 | 20 | 1.2 | 9 | 5.8 |
| 11 | 21 | 1.0 | 7 | 5.4 |
| 12 | 21 | 2.1 | 14 | 8.0 |
| 13 | 21 | 3.1 | 20 | 9.8 |
| 14 | 31 | 2.1 | 8 | 8.4 |
| 15 | 40 | 3.4 | 7 | 11.3 |

Table I shows clearly that quasi-independently of the temperature of the conditioned air, the lowest coefficients of variation result if the conditioned air exhibits a low water content as in examples 2, 3, 9, 10 and 11, in which the coefficient of variation only ranges from 5 to 6% with a water content in each case below 2 g/kg. In these examples the relative humidity was below 30%. When adhering to the conditions of the invention, the coefficient of variation even at an elevated temperature (example 15) is lower than at significantly lower temperatures outside of the range of the invention.

TABLE II

Comparison examples

| Example | T/° C. | x/(g/kg) | rH/% | V/% |
|---|---|---|---|---|
| 16 | 6 | 5.1 | 87 | 16.1 |
| 17 | 10 | 7.5 | 97 | 14.5 |
| 18 | 11 | 8.0 | 97 | 16.8 |
| 19 | 12 | 8.2 | 92 | 20.8 |
| 20 | 12 | 8.9 | 100 | 21.9 |
| 21 | 20 | 14.0 | 94 | 30.0 |
| 22 | 21 | 9.2 | 60 | 23.4 |
| 23 | 21 | 13.7 | 89 | 26.6 |
| 24 | 21 | 15.4 | 100 | 31.6 |

Table II illustrates that outside of the range of the invention the coefficients of variation of the filament cross-sectional areas are above 14% and even reach values exceeding 30%. Such high fluctuations are not desired in the manufacture of filament yarn since they negatively influence the processing into textile flat structures and lead in particular to an uneven dyeing of the flat structure. Also, based on the differing strengths of the individual filaments, and in relation to the yarn, processing problems may arise. Additionally, examples 16 and 22 show that for the present invention both requirements, i.e. a water content below 7 g water vapor per kg dry air and a relative humidity below 85%, must be guaranteed. In example 16 the water content was in the range claimed but the air exhibited a higher relative humidity, and a coefficient of variation of 16.1% resulted herefrom. Example 22 demonstrates the conditions of the ambient air at a temperature of 21% with a relative humidity of 60% and a water content of 9.2 g/kg. In this example the relative humidity is in the range claimed but not the water content, and a coefficient of variation of 23.4% results herefrom. In addition this example illustrates that in order to achieve an improvement in the textile properties, it is not sufficient to cool with ambient air, and it is not sufficient to carry out a simple blowing with room air which is cooler than the temperature generally prevailing in the air gap.

I claim:

1. A yarn of cellulose filaments produced from a solution of cellulose in a tertiary amine N-oxide and, optionally water, wherein a cross-sectional area of the filaments exhibits a coefficient of variation lower than 12%.

2. The yam of claim 1, wherein said coefficient of variation is lower than 10%.

3. The yam of claim 1, wherein said coefficient of variation is between 5% and 12%.

4. The yarn of claim 2, wherein said coefficient of variation is between 5% and 12%.

* * * * *

UNITED STATES PATENT AND TRADEMARK OFFICE

CERTIFICATE OF CORRECTION

PATENT NO. : 6,042,944
DATED : March 28, 2000
INVENTOR(S) : Jurgen PITOWSKI

It is certified that error appears in the above-indentified patent and that said Letters Patent is hereby corrected as shown below:

Column 2, line 7, change "1200" to --120°--;
line 8, change "900" to --90°--.

Column 4, line 21, after "areas" insert --(V/%).--.

Column 5, line 17, change "21%" to --21°C--;

Column 6, line 13, change "yam" to --yarn--;
line 15, change "yam" to --yarn--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*